United States Patent [19]

Sano

[11] 4,146,991

[45] Apr. 3, 1979

[54] TOY TRACKWAY

[75] Inventor: Hiroshi Sano, Tokyo, Japan

[73] Assignee: Tomy Kogyo Co., Inc., Tokyo, Japan

[21] Appl. No.: 763,517

[22] Filed: Jan. 28, 1977

[30] Foreign Application Priority Data

Apr. 22, 1976 [JP] Japan ..... 51-50388[U]

[51] Int. Cl.[2] ..... A63H 18/06

[52] U.S. Cl. ..... 46/202; 46/1 K; 273/86 B

[58] Field of Search ..... 46/1 K, 202, 216; 273/86 B; 104/60; 238/10 A, 10 E

[56] References Cited

U.S. PATENT DOCUMENTS

| | | | |
|---|---|---|---|
| 3,712,540 | 1/1973 | Yamasaki et al. | 238/10 E |
| 3,734,404 | 5/1973 | Baynes et al. | 238/10 E |
| 3,762,095 | 10/1973 | Merino et al. | 46/202 |

*Primary Examiner*—Louis G. Mancene
*Assistant Examiner*—Robert F. Cutting
*Attorney, Agent, or Firm*—Staas & Halsey

[57] ABSTRACT

A toy trackway featuring a platform having an upper level and a lower level, the upper level provided with a trackway terminating at each end in a locking member, the lower level provided with two trackways each terminating in a locking member, and two flexible trackways, each terminating in locking members for engagement with the locking members of the trackways of the upper and lower levels of the platform, thus permitting one of the locking members of each of the flexible trackways to be attached to the locking members of the trackway of the upper level and the other of the locking members of each of the flexible trackways to be attached to the locking members of the trackways of the lower level either on the same side of the platform or on opposite sides of the platform.

10 Claims, 9 Drawing Figures

48
20
16
20
18
48
32
30
34
10
10'
14
22
36
36'
30
36'
10
10
12
28
20
9
9
8
8

TOY TRACKWAY

BACKGROUND AND SUMMARY OF THE INVENTION

The present invention relates generally to a trackway along which a toy vehicle moves, and more particularly to a turn-around section which may be assembled in different configurations so as to permit the vehicle after travelling along the tortuous path of the turn-around section either to return to a position on one side of the turn-around section near the starting point, or to travel further away from the turn-around section. The turn-around section consists of a platform which has an upper level and a lower level, the upper level being provided with a trackway having locking members at each end thereof while the lower level is provided with two trackways each terminating in a locking member. Two flexible trackway sections, each terminating in locking members, are designed to connect the trackway of the upper level of the platform with different of the trackways of the lower level of the platform.

DESCRIPTION OF THE PREFERRED EMBODIMENT

Figures 1, 2, 7:
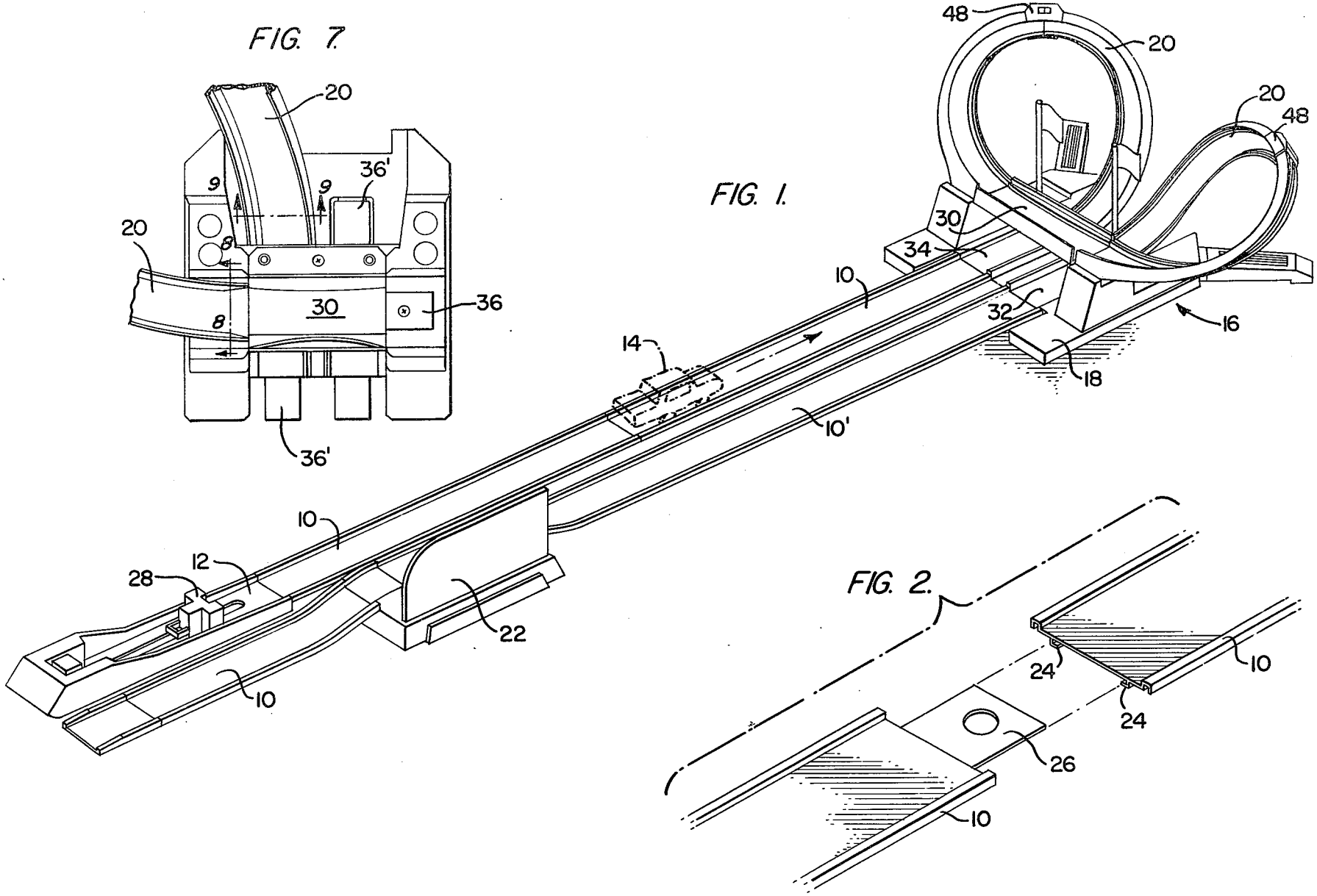
FIG. 1 is a perspective view illustrating the trackway orientated such that the turn-around section directs the vehicle back towards the vicinity of the starting point.
FIG. 2 is an exploded perspective view illustrating the locking flanges of adjacent sections of the trackway.
FIG. 7 is a top plan view of the platform assembly illustrating attachment of two of the flexible trackways to the locking members of the upper and lower levels.

The amusement device of the present invention is illustrated in FIG. 1, wherein it will be apparent that the trackway consists of a plurality of sections 10, a trigger mechanism 12 for propelling the vehicle 14, the turn-around assembly generally designated by the reference numeral 16 which consists of a platform 18 and two flexible trackways 20, and a jumping mechanism 22 which may be interposed between adjacent of the sections 10 to cause the vehicle 14 to jump into the air.

As illustrated in FIG. 2, the trackway sections 10 are provided on their underneath side with opposing flanges 24, such that the inserts 26 may be slided within the flanges 24 to secure adjacent of the sections 10 to each other. The same arrangement is employed to connect the propulsion mechanism 12 and the jumping section 22 to the trackway sections 10.

It will be apparent that the propulsion section 12 is provided with a hammer mechanism 28 which may be retracted under the influence of a spring and then released so as to propel the vehicle 14 from the propulsion section 12 along the trackway sections 10 to the turn-around section 16.

Figure 8:
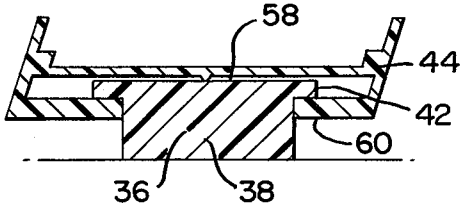
FIG. 8 is a sectional view taken along line 8—8 of FIG. 7 illustrating the configuration of the male and female locking flanges of the upper level of the platform.
Figure 9:
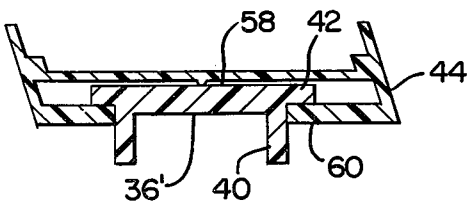
FIG. 9 is a sectional view taken along line 9—9 of FIG. 7 illustrating the configuration of the male and female locking flanges of the lower level.

The platform 18 of the turn-around section 16 is provided with an upper level along which there is defined a first trackway 30 and a lower level along which there are defined second and third trackways 32 and 34. The ends of the trackways 30, 32 and 34 terminate in first locking members in the form of male flanges 36 and 36'. The configuration of the male locking flanges 36 of the upper trackway 30 are illustrated in FIG. 8, and the configuration of the male locking flanges 36' of the lower trackways 32 and 34 are illustrated in FIG. 9. It will be apparent that although the male locking flange 36 is provided with a solid base 38 and the male locking flange 36' is provided with upstanding legs 40, both of these flanges are provided with identical side edges 42 extending outwardly along the sides. The male flanges 36' are designed to fit within the third locking members comprising the flanges 24 of the sixth and seventh trackway sections 10 and 10' such that certain of the sections 10 can be joined to the lower trackways 32 and 34 of the platform 18.

Figure 4:
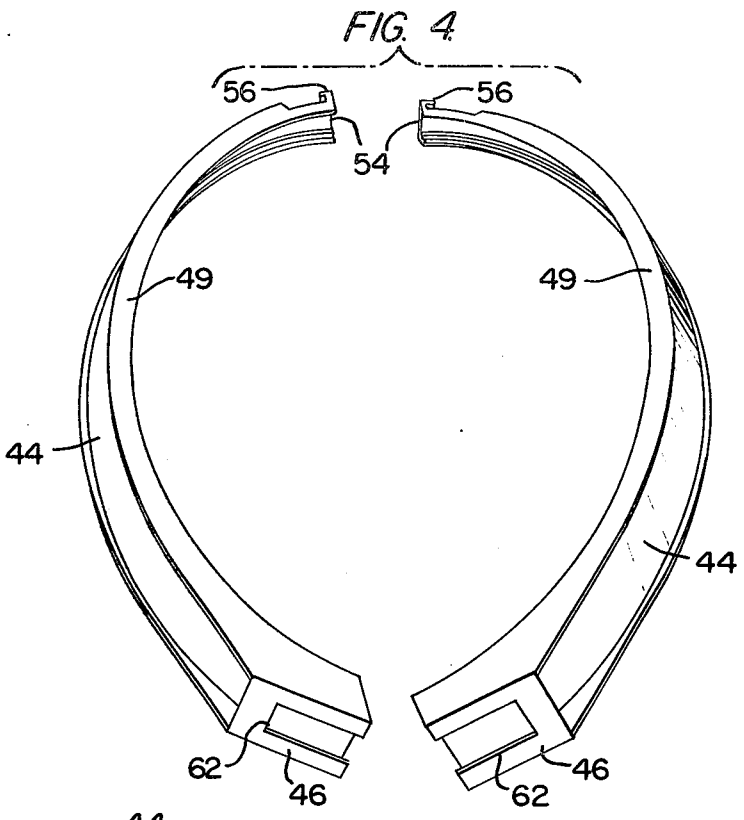
FIG. 4 is a perspective view of one of the two flexible trackways illustrating the configuration of the bottoms of the female locking flanges at each end thereof, and the two sections of which the trackway is formed spaced apart from each other prior to assembly with the clips.
Figure 5:
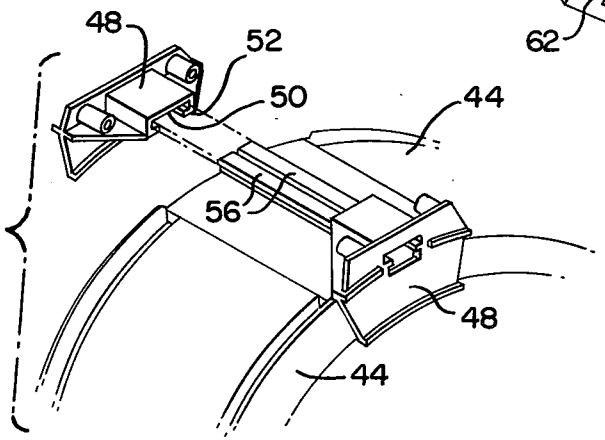
FIG. 5 is an exploded perspective view of parts of adjacent sections of one of the flexible trackways illustrating the construction of the clips which assemble these sections together.
Figure 3:
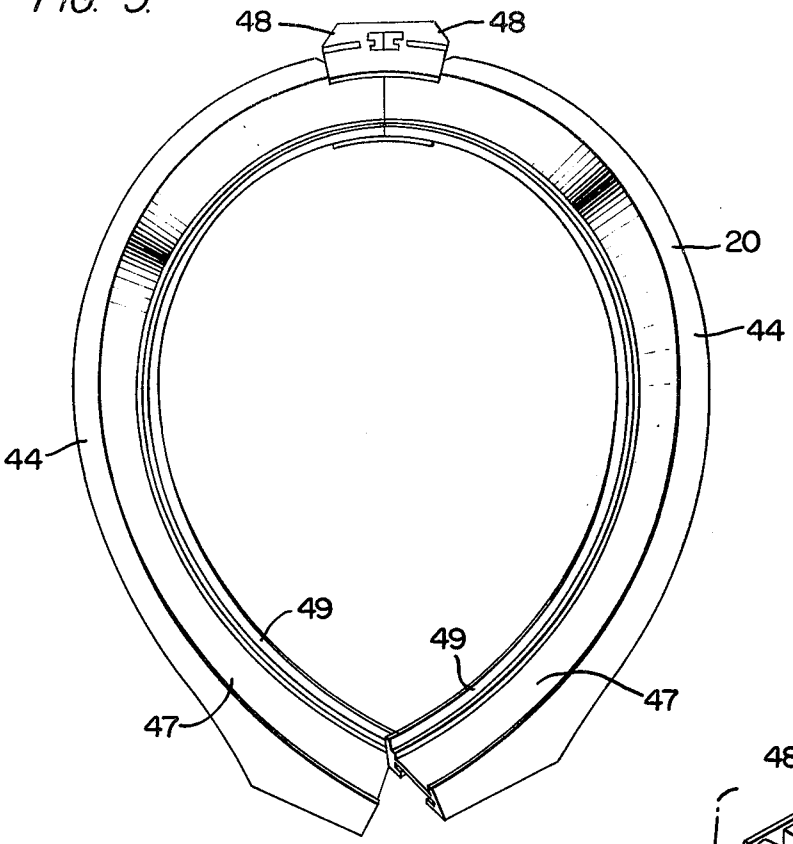
FIG. 3 is a perspective view of one of the two flexible trackways illustrating its curvature and the two sections thereof joined together with clip assemblies.

Turning now to FIGS. 3–5, it will be apparent that each of the fourth and fifth flexible trackways 20 consists of two sections 44, each of which terminates in a second locking member in the form of a female flange 46. The flexible sections 20 are joined together with clips 48, it being apparent from FIG. 5 that each of the clips 48 is provided with a supporting surface 50 and flanges 52 extending outwardly therefrom such that after the ends 54 of the sections 44 are positioned against each other in abutting relationship the clips 48 are slided over the flanges 56 formed at the ends 54 of the sections 44 such that the supporting surfaces 50 and the flanges 52 of the clips 48 engage the flanges 56 of the adjacent sections 44.

As illustrated in FIGS. 8 and 9, the ends of the female flanges 46 of the flexible trackways 20 are each provided with a lower supporting surface 58 and flanges 60 extending downwardly therefrom, it being apparent that the opening defined at the end of the flange 46 by the surface 58 and the flanges 60 is complimentary in configuration with respect to the male flanges 36 and 36'. Moreover, and as illustrated in FIG. 4, an opening 62 is provided in the bottom of the female flange 46 to accommodate the base 38 or the walls 40 of the male flanges 36 and 36'. Thus, the female flanges 46 are designed to be inserted over either the male flanges 36 of the upper level of the platform 18 or the male flanges 36' of the lower level of the platform 18.

Figure 6:
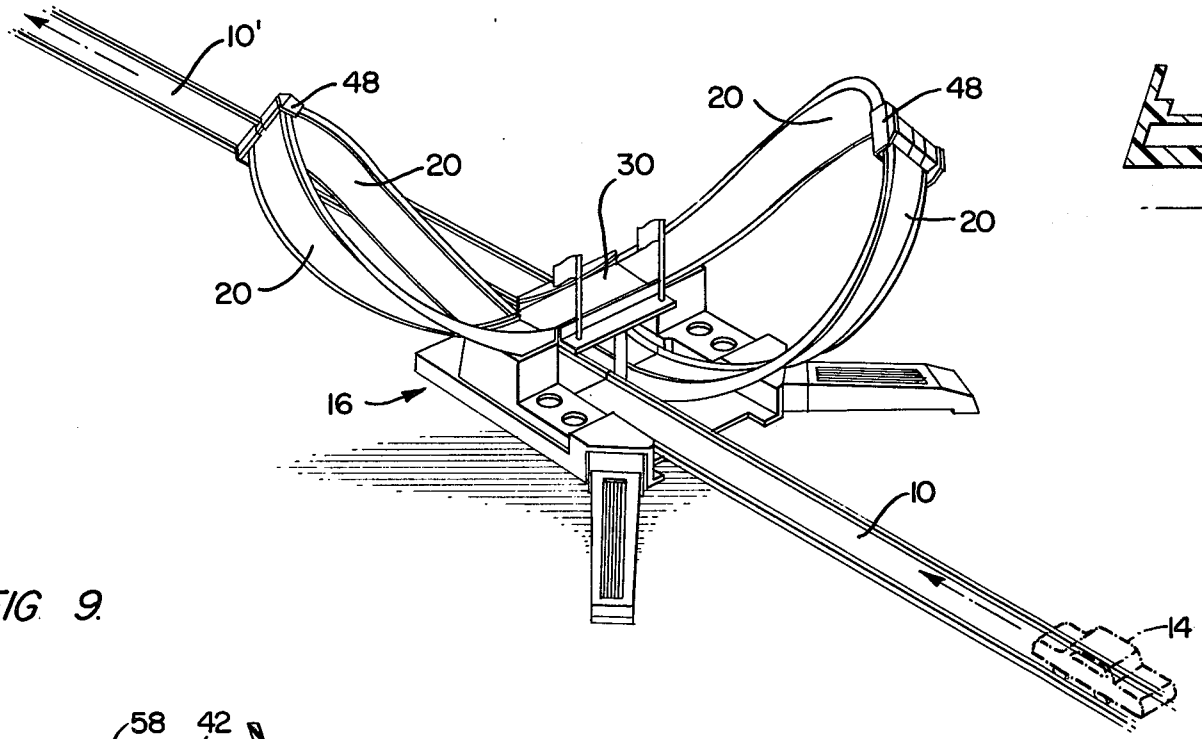
FIG. 6 is a perspective view of the trackway illustrating attachment of the flexible trackways to the platform assembly in a manner permitting the vehicle after traversing the turn-around section to continue its movement away from the turn-around section.

It will be apparent from FIG. 1 that one of the female locking flanges 46 of each of the flexible trackways 20 is attached to the corresponding male locking flanges 36 of the upper level of the platform 18. The remaining female locking flanges 46 of the flexible trackways 20 may be attached to the male locking flanges 36' of the trackways 32 and 34 of the lower level of the platform 18 on the same side of the platform 18, in which case the passageway defined by the base 47 and upstanding walls 49 of the flexible trackways 20 causes the vehicle 14 to traverse the turn-around section 16 and return along section 10' which is attached to one of the male locking flanges 36' towards the jumping section 22, the construction of which will not be described because it is not part of the present invention. Alternatively, and as illustrated in FIG. 6, it is possible to attach the other female locking flanges 46 to the male locking flanges 36' located on opposite sides of the platform 18 and the section 10' to the male locking flange 36' on the other side of the platform 18 which results in defining a passageway of different configuration causing the vehicle 14 after traversing the trackways 20 to move away from the platform 18 in the opposite direction along section 10'. Accordingly, the child is provided with the opportunity to change the configuration of the trackway from time to time.

I claim:

1. An amusement device, comprising:

a platform having an upper level and a lower level, a first trackway on said upper level along an axis and terminating in ends, second and third trackways on said lower level along axes and terminating in ends, said axes of said second and third trackways being generally parallel, said axis of said first trackway being generally perpendicular to said axes of said second and third trackways and spaced therefrom, first locking means provided at said ends of said first, second and third trackways, fourth and fifth flexible trackways terminating in ends, second locking means provided at said ends of said fourth and fifth trackways, and sixth and seventh trackways terminating in ends, third locking means provided at at least one of said ends of each of said sixth and seventh trackways, and said first locking means being complementary to said second and third locking means enabling said ends of said trackways associated therewith to be joined together such that said ends of said fourth and fifth flexible trackways may be joined to any of said ends of said first, second and third trackways and said ends of said sixth and seventh trackways may be joined to any of said ends of said second and third trackways.

2. An amusement device as in claim 1, wherein said fourth and fifth trackways each comprise two sections, and clip means joining said sections.

3. An amusement device as in claim 1, wherein each of said first locking means comprises a male flange having side walls and edges extending outwardly from said side walls, and wherein each of said second locking means comprises a female flange having an opening formed in the end of said trackway associated therewith that is complementary in configuration with respect to said edges of said male flange and an opening formed in a wall of said trackway and extending inwardly from said end thereof for accommodating said side walls of said male flange.

4. An amusement device as in claim 1, wherein said fourth and fifth trackways are each curvalinear in configuration having a base and walls extending upwardly from the sides of said base, one of said walls intersecting said base at an acute angle and the other of said walls intersecting said base at an obtuse angle, said walls being parallel throughout all cross sections of said fourth and fifth trackways.

5. An amusement device, comprising a platform having an upper level provided with a first trackway terminating at each end in a locking flange, a lower level provided with second and third trackways spaced from said first trackway and positioned in a non-parallel relationship with respect to said first trackway, said second and third trackways terminating at each end in a locking flange, fourth and fifth flexible trackways each being curvalinear in configuration and having a base with walls extending upwardly from the sides thereof, one of said walls forming an acute angle with respect to said base and the other of said walls forming an obtuse angle with respect to said base, said walls being parallel to each other, said fourth and fifth flexible trackways terminating at each end in a locking flange that is complementary to said locking flanges of said first, second and third trackways permitting said ends of said fourth and fifth flexible trackways to be connected to said ends of said first, second and third trackways, as desired.

6. An amusement device as in claim 5, wherein said fourth and fifth trackways each comprise two sections, and clip means joining said sections.

7. An amusement device as in claim 5, wherein said locking flanges of said first, second and third trackways comprise a male flange having side walls and edges extending outwardly from said sidewalls, and wherein said locking flanges of said fourth and fifth flexible trackways comprise a female flange having an opening formed in the end of said trackway associated therewith that is complementary in configuration with respect to said edges of said male flange and an opening formed in a wall of said trackway and extending inwardly from said end thereof for accommodating said side walls of said male flange.

8. An amusement device as in claim 7, further comprising sixth and seventh trackways terminating in ends, a female locking flange formed at at least one of said ends of said sixth and seventh trackways having an opening that is complementary in configuration with respect to said edges of said male flanges of said second and third trackways permitting said ends of said sixth and seventh trackways to be connected to said ends of said second and third trackways, as desired.

9. An amusement device as in claim 1, further comprising a propulsion mechanism connected to said sixth trackway, and a vehicle for movement along said first, second, third, fourth, fifth and sixth trackways.

10. An amusement device as in claim 8, further comprising a propulsion mechanism connected to said sixth trackway, and a vehicle for movement along said first, second third, fourth, fifth and sixth trackways.

* * * * *